United States Patent [19]

van der Lely

[11] 4,117,662

[45] Oct. 3, 1978

[54] WATCHES

[76] Inventor: Cornelis van der Lely, 7 Brüschenrain, Zug, Switzerland

[21] Appl. No.: 742,242

[22] Filed: Nov. 16, 1976

[30] Foreign Application Priority Data

Nov. 17, 1975 [NL] Netherlands ..... 7513381

[51] Int. Cl.² ..... G04B 37/12; G04C 19/00

[52] U.S. Cl. ..... 58/50 R; 58/88 R

[58] Field of Search ..... 58/4 A, 23 R, 50 R, 58/58, 88 R, 88 E, 152 R

[56] References Cited

U.S. PATENT DOCUMENTS

| | | | |
|---|---|---|---|
| 1,404,536 | 1/1922 | Maculskiys | 58/88 R |
| 3,224,184 | 12/1965 | Brien | 58/88 R X |
| 3,783,604 | 1/1974 | Florent et al. | 58/50 R |
| 3,783,607 | 1/1974 | Feurer | 58/50 R X |
| 3,823,551 | 7/1974 | Riehl | 58/23 R |
| 3,975,899 | 8/1976 | Haber | 58/88 R |
| 4,003,196 | 1/1977 | O'Connor et al. | 58/4 A |

*Primary Examiner*—Stanley J. Witkowski

*Attorney, Agent, or Firm*—Mason, Mason & Albright

[57] ABSTRACT

Wrist and ring mounted watches having a display face and an actuation mechanism to illuminate the display face. For a wrist watch, the display face is disposed on one side of the watch case adjacent the watch band with the actuation mechanism on the opposite side of the case whereby through moving the case against a sufficiently solid object, the display face is illuminated. Alternately, the wrist band may be expansible where it connects to the case and by twisting the wrist sufficiently to expand same, the mechanism is actuated which illuminates the display face. With a ring watch, the actuation mechanism is a nob on the side of the case or of the ring whereby it can be actuated by an adjacent finger.

22 Claims, 14 Drawing Figures

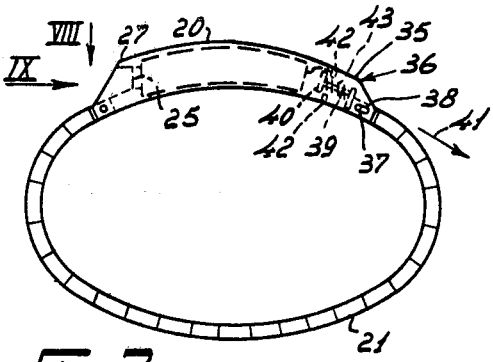
FIG. 7
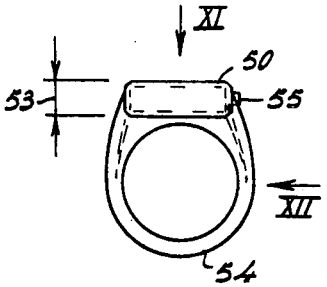
FIG. 10
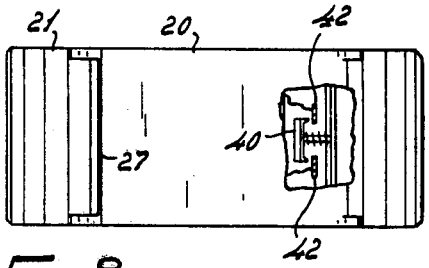
FIG. 8
FIG. 11
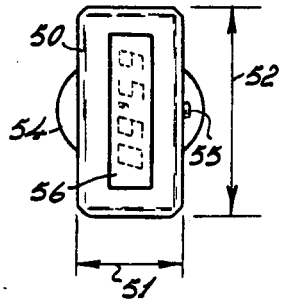
FIG. 12
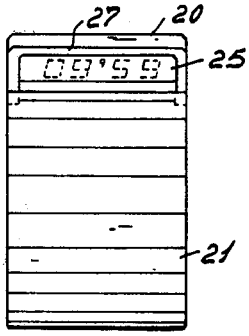
FIG. 9
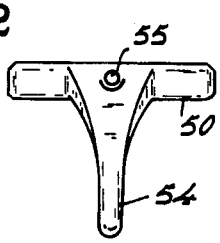
FIG. 13
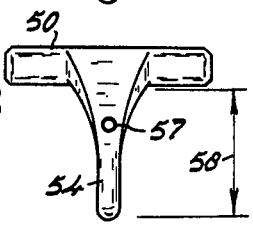
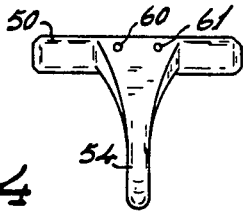
FIG. 14

WATCHES

SUMMARY OF THE INVENTION

This invention relates to watches and is particularly concerned with watches having a display face and mechanism for illuminating or forming images on this display face to indicate the time. It is known to provide such a watch with a control-knob which can be actuated by pressure to actuate this mechanism.

According to one aspect of the present invention there is provided a watch having a display face and mechanism for illuminating or forming images on this display face to indicate the time, the watch being connected with a fastening member for fastening the watch on a finger, the mechanism including actuating means disposed for operation by one of the other fingers of the same hand. Preferably the fastening member is in the form of a finger ring, and in this case the actuating means can be a control-knob arranged in the ring.

According to another aspect of the present invention there is provided a watch having a case with a display face and mechanism for illuminating or forming images on this display face to indicate the time, the case being connected with a bracelet that is fastened to at least one side of the case by a connection that comprises at least partly actuating means of said mechanism. Preferably the construction is such that by a movement of the arm bearing the watch, or of the hand of this arm, the actuating means can be operated to cause the time to be displayed.

For a better understanding of the invention and to show how the same may be carried into effect, reference will now be made, by way of example, to the accompanying drawings, in which:

BRIEF DESCRIPTION OF THE DRAWINGS

FIG. 7 shows a further embodiment of a wrist watch, FIG. 8 is a plan view of the watch shown in FIG. 7, partly broken away to show a structural part schematically, FIG. 9 is a side elevation of the watch shown in FIG. 7 taken in the direction of the arrow IX in FIG. 7, FIG. 10 is an elevational view of a ring watch, FIG. 11 is a plan view of the watch shown in FIG. 10, viewed in the direction of the arrow XI in FIG. 10, FIG. 12 is a side elevation of the watch shown in FIG. 10 taken in the direction of the arrow XII in FIG. 10, FIG. 13 is an elevational view like FIG. 12 of an alternative form of ring watch, and FIG. 14 is a side elevation like FIG. 12 of a further form of ring watch.

DESCRIPTION OF THE PREFERRED EMBODIMENTS

Figure 1:
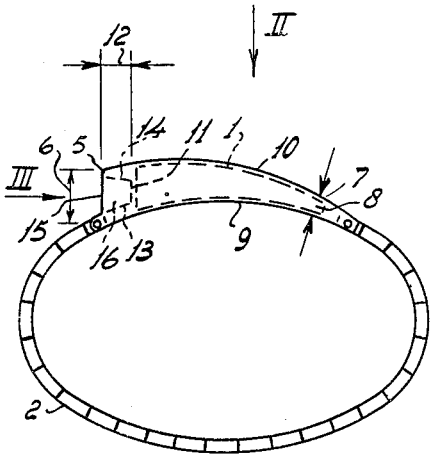
FIG. 1 is a side elevation of a wrist watch.
Figure 2:
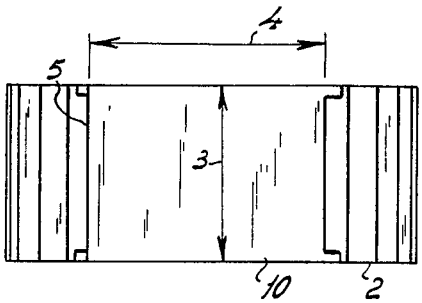
FIG. 2 is a plan view of the watch shown in FIG. 1.
Figure 3:
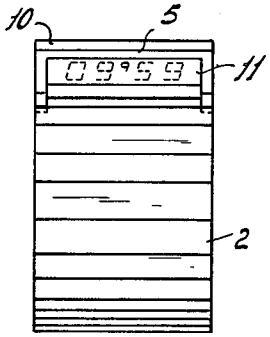
FIG. 3 is an elevational view of the watch shown in FIG. 1 taken in the direction of the arrow III in FIG. 1.

The wrist watch shown in FIGS. 1, 2 and 3 has a case 1 that accommodates a time mechanism and that is pivotally fastened at opposite sides to a bracelet 2. The watch case 1 is rectangular, viewed on plan, having a width 3 and a length 4. Viewed from the side (FIGS. 1 and 3) the case 1 is thin and has a height 6 along one short side 5 of the rectangle that is about three times the height or thickness near the other short side 7. The case 1 has a slightly concave inner face 9. The outer face 10 gradually slopes from the side 5 towards the side 7 so that the height of the case gradually decreases from the side 5 towards the side 7. Recessed within the case near and high side 5 is a display face 11, on which a time indication in hours and minutes, and in some forms seconds, or the date, are displayed. The face 11 is rectangular and elongated and is located in a cavity 16 at a distance 12 from the side 5 of the case 1. The lower and upper faces 13 and 14 respectively of the cavity 16 converge towards the display face 11. Along the side 5 the cavity 16 is covered by a transparent cover 15, for example of glass.

As the display face 11 is located on the side of the case 1, and particularly as the watch is a wrist watch, reading of the time indication is facilitated as it is not necessary to turn the arm to an appreciable extent to view the display face. To this end it is preferable that the watch is worn such that the display face 11 is located on that side of the wearer's arm which faces his body and eyes. Owing to the location of the display face 11 at a distance 12 inside the case, the face 11 is shielded from external light to an extent such that a mirror effect on the face 11, or on the cover 15, is avoided. Locating the display face 11, on the side of the watch case 1 is particularly suitable for digital time indication, which is shown in FIG. 3 by way of example for the time of 1 minute before 10 o'clock.

Figure 4:
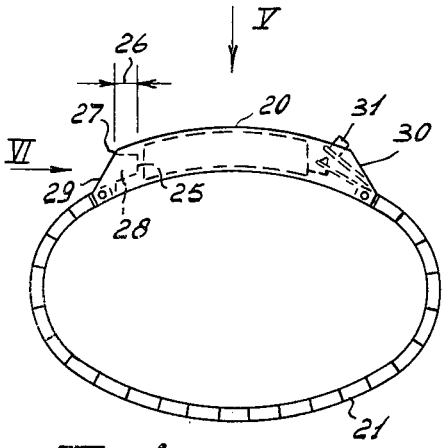
FIG. 4 is a side elevation of a further embodiment of a wrist watch.
Figure 5:
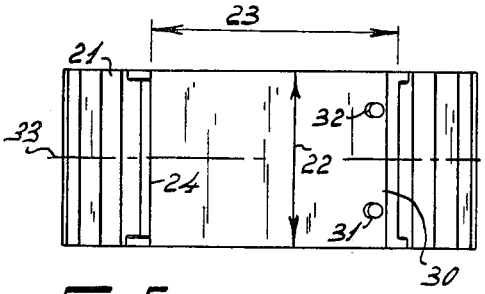
FIG. 5 is a plan view of the watch shown in FIG. 4 taken in the direction of the arrow V in FIG. 4.
Figure 6:
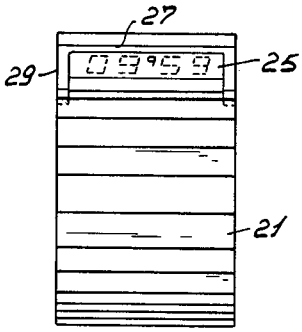
FIG. 6 is a side elevation of the watch shown in FIG. 4 taken in the direction of the arrow VI.

The wrist watch shown in FIGS. 4, 5 and 6 has a case 20 to which a bracelet 21 is fastened. Viewed from the side (FIG. 4) the case 20 is thin and substantially flat and rectangular, being only slightly curved to match the shape of a wrist. The case 20 is also rectangular viewed in plan (FIG. 5), having width 22 and a length 23. Near a short side 24, where the case is pivotally connected with the bracelet, a display face 25 is provided inside the case 20 at a distance 26 from the side 24, the face 25 being in a cavity 28 that is covered at the side 24 by an inclined, transparent cover 29, for example of glass. Near the side 25 opposite the side 24 there are two control-knobs 31 and 32 of a control-mechanism. The knobs 31 and 32 are located one on each side, and at a distance from, the longitudinal center line 33 of the case 20. Actuation of one of the knobs, for example 31, causes display of the time in hours and minutes on the display face 25, whereas actuation of the other knob 32 causes the date to be displayed on the face 25. If desired, a further control-knob may be provided for actuating a time indication in seconds, or if desired it can be that actuation of the knob 31 brings about display of the time in hours, minutes and seconds. As in the case of the watch of FIGS. 1 to 3, the disposition of the display face 25 facilitates reading the indications displayed.

The watch is particularly suitable for computer-controlled time and date indications on the display face 25. The indication may be constant (in which case, e.g. one or more of the control knobs are omitted) or it may appear only upon the depression of one or other of the control-knobs 31, 32. The knobs 31 and 32 are preferably push-buttons on which a pressure is exerted for producing the display on the face 25. However, different kinds of control-knobs, for example, sliding knobs may be employed. It is advantageous to subject the control-knobs to spring action so that they are constantly held in a predetermined initial position, in which they are inoperative. The location of the knobs is preferably such that they can be readily actuated by pressing them against any object so that manual actuation is not necessary.

The wrist watch shown in FIGS. 7, 8 and 9 corresponds basically with the embodiment shown in FIGS. 4, 5 and 6, the control-knobs 31 and 32 being, however, omitted. Instead the fastening 36 of the bracelet 21 to the case 20 includes, near one side 35, a control-mechanism which becomes operative when the stress on the bracelet 21 increases, for example, by a movement of the arm. For example, a movement of the hand with respect to the arm will cause the arm to expand so that the end of the bracelet fastened to the case 20 is displaced with respect to the case, for example, by providing a pivot pin 37 mounted in slots 38. The pin 37 serves for actuating a switching mechanism, for example, of the kind shown schematically in FIG. 7, which comprises a rod 39 carrying a knob 40. When the pin 37 moves in the direction of the arrow 41, the knob 40 comes into contact with a counter-contact 42. The rod 39 is surrounded by a spring 43 which holds the switching member 40, 42 in-operative in the normal position. When the switching member 40, 42 is actuated the time mechanism, for example, an electronic mechanism, is actuated so that a time indication is displayed on the display face, for example, in digits, preferably the spring 43 is acting in such a way that movement between the case of the watch and the bracelet is minimized for contacting the switch-members 40 and 42.

The finger watch shown in FIGS. 10, 11 and 12 has a substantially flat case 50 having a height 53. The dimensions of the case may be varied. The watch case 50 is mounted on a ring 54 which can be slipped onto a finger. The watch case 50, viewed on plan (FIG. 11) is substantially rectangular and has a width 51 and a length 52. In this embodiment the case and the ring are rigidly secured to one another. A long side of the case is provided with a control-knob 55 in the form of a push-button for actuating the time mechanism so that the time is displayed in digits on the display face 56 as is shown in FIG. 11 for the time of one minute before ten o'clock. The knob 55 is disposed on one side of the ring so that it can be actuated by a finger of the hand concerned, for example, by a finger located near the finger carrying the ring with the watch. As a matter of course, the knob 55 may be actuated in a different way.

FIG. 13 shows an alternative position of the control-knob 57, which is here located at approximately midway the height 58 of the ring or slightly higher. At this place the control-knob 57 can be readily actuated by the thumb, when the space between the fingers, one of which is carrying the ring, is made free. Although, viewed on plan, the control-knob 57 is located on the right-hand side of the ring, it may in principle also be fastened to the opposite long side so that the knob 57 can be actuated by a finger located on the other side of the finger carrying the ring. If desired, a push-button may be provided on each side of the ring so that the actuation of one button may result in a time indication in, for example, four digits and the actuation of the other button in an indication of the date on the display face 56.

FIG. 14 is a side elevation of an embodiment in which two control-knobs 60 and 61 are shown side by side. As described for the knobs 31 and 32, one knob may serve for the indication of time in hours and minutes and the other for date indication.

In some cases it may be of worth to provide the actuating mechanism with a change-over contact so that repeated actuation of the mechanism alternatively produces different indications, e.g. alternatively a time indication in hours and minutes and a date indication on the display face.

As has already been mentioned, the watch constructions described are particularly applicable to digital time indications by, for example, computer-controlled timers.

What we claim is:

1. A watch to be worn on a finger comprising a case, a display face and mechanism for producing images on said display face for viewing by the wearer of the ring mounted on said case, fastening means connected to said case for fastening the watch on a finger, said mechanism including actuating means comprising at least one push button for actuating same whereby an image is produced on said display face, said push button being disposed so that it can be readily operated by one of the other fingers of the same hand.

2. A watch as claimed in claim 1, wherein said fastening means comprises a finger ring.

3. A watch as claimed in claim 2, wherein said fastening means comprises a ring, said ring rigidly secured to said case.

4. A watch as claimed in ring 3, wherein said case is elongated in a direction at right angles to said ring.

5. A watch as claimed in claim 3, wherein said push button is arranged near the connection of said ring to said case.

6. A watch as claimed in claim 5, wherein said push button is arranged on said ring.

7. A watch as claimed in claim 3, wherein said push button is arranged in said ring midway its height, measured at least substantially at right angles to the face of said case facing said ring.

8. A watch as claimed in claim 3, wherein said actuating means comprises a further push button arranged by said first mentioned push button, one said push button serving for initiating time indication.

9. A watch as claimed in claim 3, wherein said display face is substantially rectangular in configuration and has long and short sides, said long sides being at right angles to said ring.

10. A watch for being worn on a wrist comprising a case, a display face and mechanism for illuminating or forming images on this display face to indicate time mounted in said case, said case being connected with and forming part of a bracelet, said bracelet including resilient expansible connective means which expands on resilient expansion of said bracelet, said connective means comprising at least in part actuating means of said mechanism whereby said connective means performs the function of causing said display face to be illuminated or images formed thereon solely in response to the resilient expansion of said bracelet.

11. A watch as claimed in claim 10, wherein said display face is arranged near one side of said case and said actuating means is arranged on that side of said case which is opposite said one side.

12. A watch as claimed in claim 11, wherein said connective means provides relative movement of the portion of said bracelet which is not part of said case with respect to said case whereby when said bracelet portion moves with respect to said case said actuating mechanism is operated thereby to initiate time indication.

13. A watch as claimed in claim 12, wherein said bracelet portion is connected with said case to be displaceable in a direction of the length of said bracelet.

14. A watch as claimed in claim 13, wherein said connective means includes a spring structure adapted to minimize movement between said bracelet portion and said case for operating said actuating mechanism.

15. A watch for being worn on a wrist comprising a case which is arcuate along its side worn next to the skin, said case having a substantially planar display face which is disposed at an acute angle relative to the proximate portion of said arcuate side and actuating means for initiating a time indication on said display face, said actuating means comprising a push button which can be actuated by exerting a force thereon in a direction towards a further portion of said arcuate side which is proximate thereto and which is arranged in said case so that the wearer of watch can press said push button against an object not part of his person which actuates same while said display face remains satisfactorily visible to the wearer during such actuation of said push button; said display face being located in the region of one edge for connection to means for retaining same on a wrist of said case and said push button being located in the further region near the other edge of said case that is opposite said one edge.

16. A watch as claimed in claim 15, wherein said push button protrudes from said case.

17. A watch as claimed in claim 16, wherein said push button is located proximate said other edge of said case.

18. A watch as claimed in claim 15, wherein said case is elongated, and wherein said push button is spaced a substantial relative distance from the longitudinal center line of said case.

19. A watch as claimed in claim 18, wherein said push button is associated with resilient means which urges said control-knob to move into one predetermined position.

20. A watch as claimed in claim 19, wherein said push button is arranged on a flat area provided on said case.

21. A watch as claimed in claim 19, wherein said push button is arranged on said flat side of said case whereby it is movable in a direction of substantially 90° relative to said flat side.

22. A watch as claimed in claim 19, wherein said push button is located, viewed at right angles to said display face, in a side of said case which joins the top of said display face.

* * * * *